US010427448B2

(12) United States Patent
Busam et al.

(10) Patent No.: US 10,427,448 B2
(45) Date of Patent: Oct. 1, 2019

(54) MOVEABLE TAB

(75) Inventors: Edward P. Busam, Mason, OH (US); Kenneth P. Richied, Cincinnati, OH (US); Kevin W. Witter, Fort Collins, CO (US)

(73) Assignee: ACCO Brands Corporation, Lake Zurich, IL (US)

( * ) Notice: Subject to any disclaimer, the term of this patent is extended or adjusted under 35 U.S.C. 154(b) by 0 days.

(21) Appl. No.: 13/357,639

(22) Filed: Jan. 25, 2012

(65) Prior Publication Data

US 2012/0201594 A1 Aug. 9, 2012

Related U.S. Application Data

(60) Provisional application No. 61/439,506, filed on Feb. 4, 2011.

(51) Int. Cl.

| | |
|---|---|
| ***B42F 21/00*** | (2006.01) |
| ***B65D 27/00*** | (2006.01) |
| ***B42F 21/06*** | (2006.01) |
| ***G09F 23/10*** | (2006.01) |

(52) U.S. Cl.

CPC ..... *B42F 21/06* (2013.01); *G09F 23/10* (2013.01)

(58) Field of Classification Search

CPC ..... B42F 21/00; B42F 13/00; B42F 21/06; B65D 27/00; G09F 3/10; G09F 23/10

USPC ..... 283/36, 37, 38, 39, 40, 41, 42, 43; 402/79; 40/359, 360, 638

See application file for complete search history.

(56) References Cited

U.S. PATENT DOCUMENTS

| | | | | |
|---|---|---|---|---|
| 2,260,407 | A | | 10/1941 | Schade |
| 2,328,741 | A | | 9/1943 | Reiste |
| 2,438,282 | A | | 3/1948 | Gruver et al. |
| 2,603,219 | A | | 7/1952 | Jones |
| 2,623,311 | A | | 12/1952 | Condon |
| 2,808,871 | A | | 10/1957 | Brown |
| 2,878,814 | A | | 3/1959 | Consaul |
| 3,196,564 | A | | 7/1965 | Boedeker |
| 3,204,639 | A | | 9/1965 | Kleffman |
| 3,248,814 | A | | 5/1966 | Zwolinski et al. |
| 3,604,067 | A | | 9/1971 | Brown |
| 3,849,922 | A | * | 11/1974 | Sahlin ..... B42F 21/10 40/360 |
| 4,053,057 | A | | 10/1977 | Snowden |
| 4,079,533 | A | | 3/1978 | Rohner |
| 4,201,403 | A | | 5/1980 | Turner |
| 4,430,015 | A | | 2/1984 | Nerlinger |
| 4,660,855 | A | | 4/1987 | Pagliaccio |
| 4,849,056 | A | | 7/1989 | Ristuccia, Sr. |
| 5,033,899 | A | | 7/1991 | Pitts et al. |
| 5,187,888 | A | * | 2/1993 | O'Brien ..... B42F 21/065 40/359 |

(Continued)

*Primary Examiner* — Justin V Lewis

(74) *Attorney, Agent, or Firm* — Fitch, Even, Tabin & Flannery LLP

(57) ABSTRACT

A tab system including a tab for attachment to a component, the tab having a display portion proximate to a first edge of the tab and a pair of attachment portions. Each attachment portion is located on a corner of the tab along a second edge opposite from the first edge. Each attachment portion includes curved or angled, generally parallel upper and lower edges, or, alternately each attachment portion includes a pair of generally parallel, spaced-apart outwardly-extending legs.

37 Claims, 7 Drawing Sheets

(56) References Cited

U.S. PATENT DOCUMENTS

| | | | | |
|---|---|---|---|---|
| 5,503,487 | A * | 4/1996 | Ong | B42F 21/10 281/38 |
| 5,683,113 | A | 11/1997 | Petrucci | |
| 5,707,001 | A | 1/1998 | Mark et al. | |
| 6,099,189 | A | 8/2000 | Owen et al. | |
| 6,332,285 | B1 | 12/2001 | Aaldenberg et al. | |
| 6,672,785 | B1 | 1/2004 | O'hara et al. | |
| 6,732,461 | B2 | 5/2004 | Slattery et al. | |
| 7,731,442 | B2 | 6/2010 | Barausky et al. | |
| 2003/0089762 | A1 | 5/2003 | Mark et al. | |
| 2005/0093290 | A1 | 5/2005 | Richied | |
| 2010/0183358 | A1 | 7/2010 | Kelley | |

* cited by examiner 42
44
48
52
52
60
56
56
58
60
58
50
50
59
59
54
54
46

58A
58E
58D
58C
58B 59A
59C
59B
59D

MOVEABLE TAB

REFERENCE TO RELATED APPLICATION

This application claims the benefit of priority under 35 U.S.C. § 119(e) of U.S. provisional application Ser. No. 61/439,506 filed on Feb. 4, 2011, which is hereby incorporated by reference in its entirety.

The present invention is directed to a tab usable in conjunction with a divider or folder, and more particularly, to such a tab that is movable to various positions on a divider or folder or movable between differing dividers or folders.

BACKGROUND

Dividers, folders, pockets and the like are widely used in notebooks, binders, etc. to divide the notebook or binder into discrete segments for quick and easy access. Such dividers may include a tab which extends outwardly from the main body of the divider so that a user can quickly identify and utilize the divider. However, many such tabs are located at a fixed, predetermined position, which limits the usefulness of a tab, and/or requires a user to obtain a replacement divider should a divider having a different tab placement be desired.

SUMMARY

Accordingly, in one embodiment, the present invention is a tab which can be moved to various positions along a divider, pocket or folder, and which can be moved from one divider, pocket or folder to another. More particularly, in one embodiment, the invention is a tab system including a tab for attachment to a component, the tab having a display portion proximate to a first edge of the tab and a pair of laterally extending attachment portions. Each attachment portion is located on a corner of the tab along a second edge opposite from the first edge, or the attachment portion may be located to extend from the side edges between the first and second edges. Each attachment portion includes curved or angled, generally parallel upper and lower edges, or, alternately, each attachment portion includes a pair of generally parallel, spaced-apart outwardly-extending legs.

DETAILED DESCRIPTION

Figure 1A:
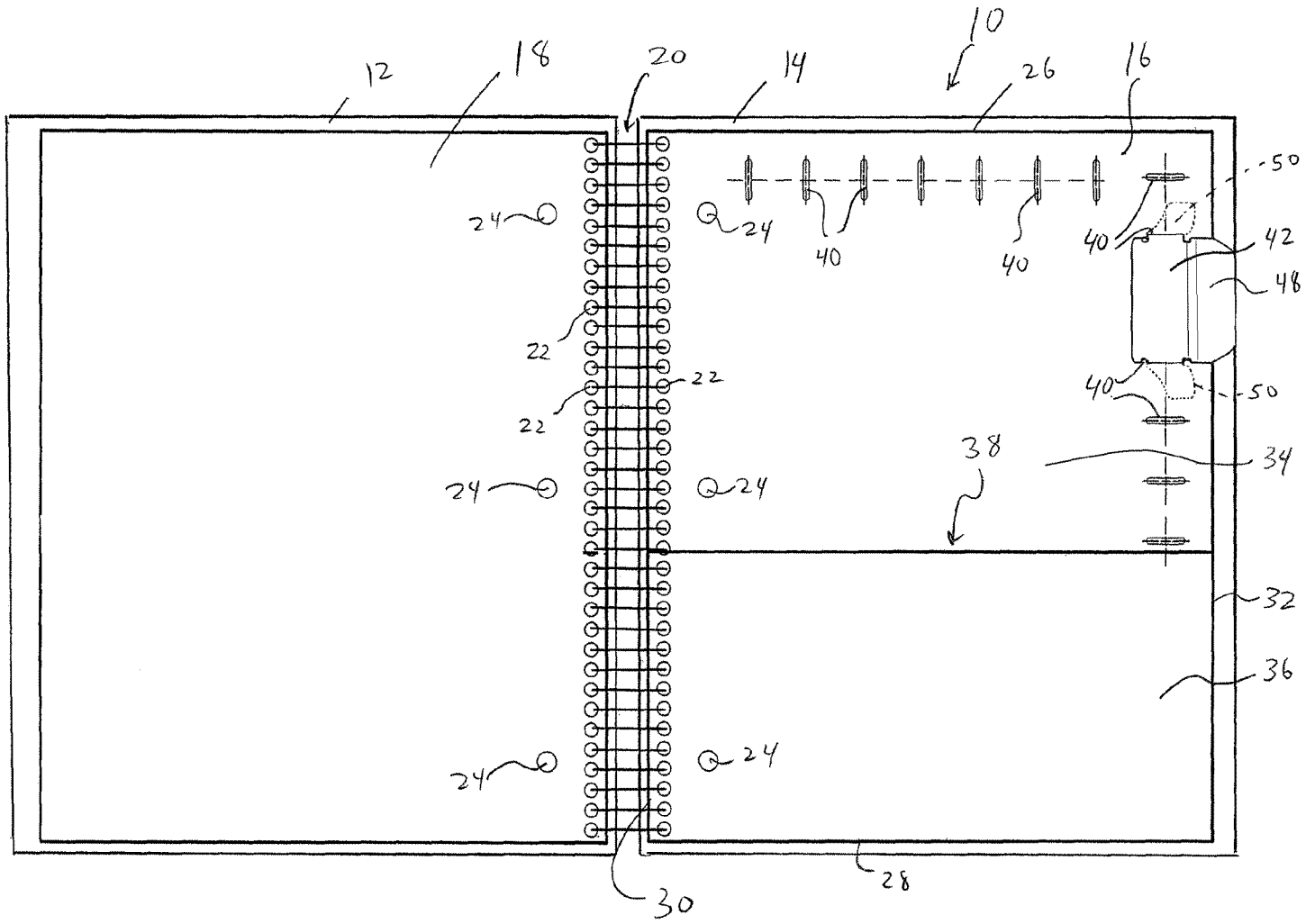
FIG. 1A is a plan view of a notebook with a pocket divider incorporating one embodiment of the tab of the present invention.

FIG. 1A illustrates a notebook, generally designated 10, having a front cover 12, rear cover 14, a divider 16 and a plurality of sheets of paper 18 bound by a binding device 20. In the illustrated embodiment the binding device 20 takes the form of a coil binding device and the covers 12, 14, divider 16 and sheets of paper 18 each includes a plurality of openings 22 formed along the associated inner edge to receive a coil of the binding device 20 therethrough. However, the binding device can take any of a wide variety of forms besides a coil, including a spiral binding device, twin or non-spiral wire binding, ring binding, adhesives, spines, prongs, clips, tabs, a book-style binding and the like. The notebook 10 may also have a set of holes 24 formed therethrough which are spaced and configured to receiving a binding ring of a standard three-ring binder therethrough. The divider 16 shown in FIG. 1A includes a pocket and thus may be considered a "pocket divider." However, the divider may also be useful without a pocket. Covers 12, 14 may be "oversize" and extend on any or all edges beyond the sheets 18, dividers 16, and even tab display portions 48 (described below); however, the covers 12, 14 may have some or all edges aligned with the corresponding edges of the sheets or dividers. The tab display portions 48 may extend beyond the edges of the covers 12, 14.

The divider 16 has an upper edge 26, lower edge 28, an inner edge 30 positioned adjacent to the binding device 20, and an outer edge 32 positioned opposite the inner edge 30. The illustrated divider 16 includes a main panel 34 and a lower panel 36 facing, and secured to, the main panel 34 to define a pocket 38 therebetween. If desired the divider 16 may have various internal pockets, or pockets on the opposite side thereof. Moreover, in some cases the divider 16 may simply be a divider and lack any pockets thereon.

The divider 16 has a plurality of slots 40 formed therein or therethrough. In the illustrated embodiment, the slots 40 are regularly spaced along the upper edge 26 and outer edge 32 of the divider 16, and extend generally perpendicular to the associated edge. In one embodiment, each slot 40 may extend entirely through the main panel 34. However, in some cases, the divider 16 may include a panel or other covering surface on the opposite side thereof to cover the opposite side of the slots 40.

Figure 1B:
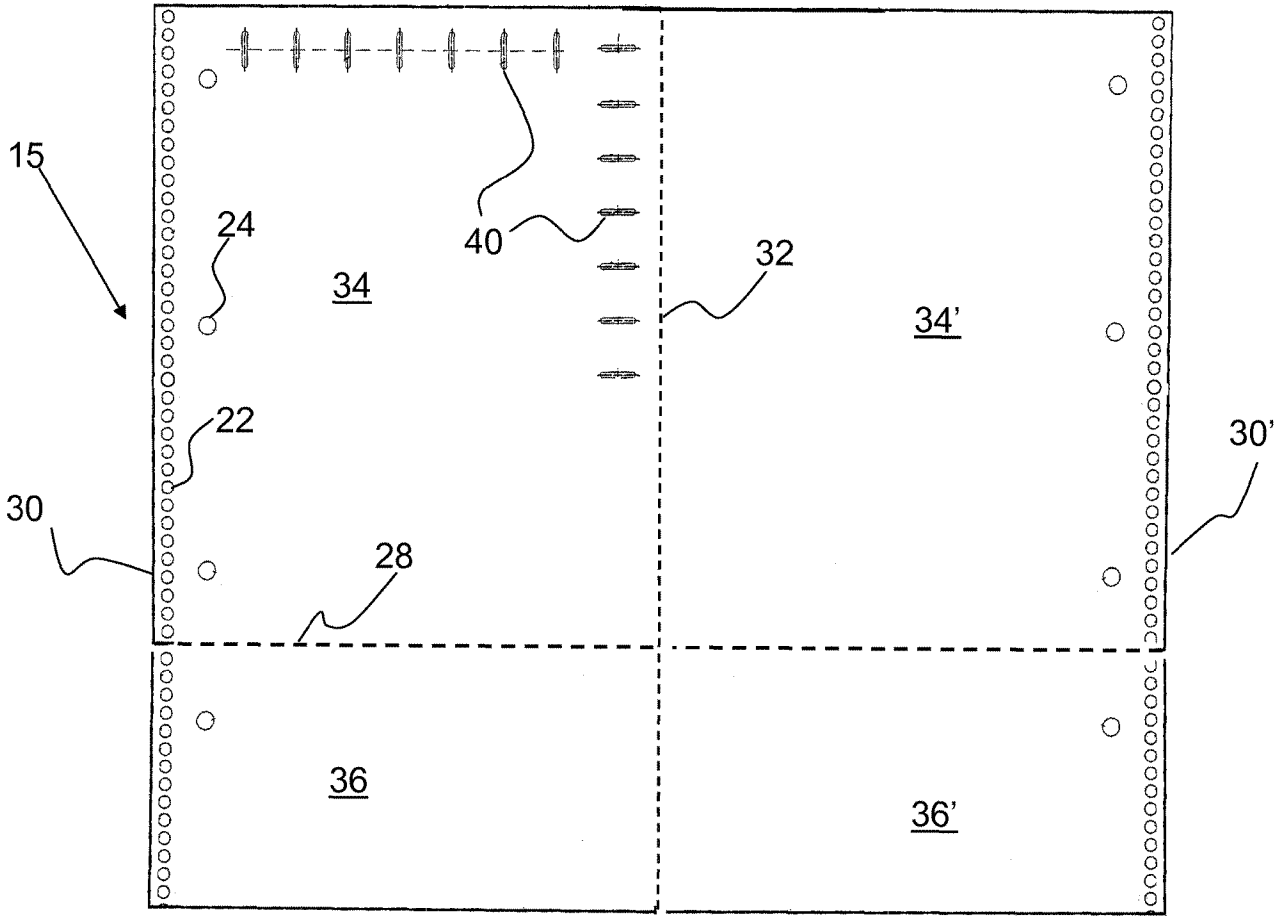
FIG. 1B is a plan view of a blank for forming a pocket divider as in FIG. 1A.

By way of example, FIG. 1B shows a blank 15 from which divider 16 may be formed. Blank 15 is divided into four sections by horizontal and vertical fold lines which will define the lower edge 28 and the outer edge 32 of the divider 16. Starting with the blank 15 as shown in FIG. 1B, lower panels 36, 36' may first be folded upward along fold line 28 to lie upon main panels 34, 34' respectively. The combined panels 34', 36' may then be folded back around fold line 32, bringing inner edges 30, 30' together, to form a divider 16 which includes two plies of material in the upper part of the main panels 34, 34' and four plies of material in the area of the lower panels 36, 36'. Thus are formed pockets 38 (shown in FIG. 1A) and 38' (on the reverse side of the divider, not shown).

Slots 40 may be provided as shown on only one side of the divider, for example in the main panel 34. Alternately the slots may be provided in both sides, that is, in main panels 34 and 34'. Openings 22 and holes 24 may be provided as shown on both sides of the divider, along the inner edges 30, 30'.

The divider as shown in FIG. 1A and the blank 15 as shown in FIG. 1B should be considered as only examples, as other embodiments of the divider may be achieved with only one pocket, or with no pocket at all. Furthermore the main panel may either be two-ply as described, or a single ply of material. In another embodiment the main panel may be two-ply in the vicinity of slots 40, for example along edges 26 and 32, but single ply elsewhere.

Figures 2A, 2B, 2C:
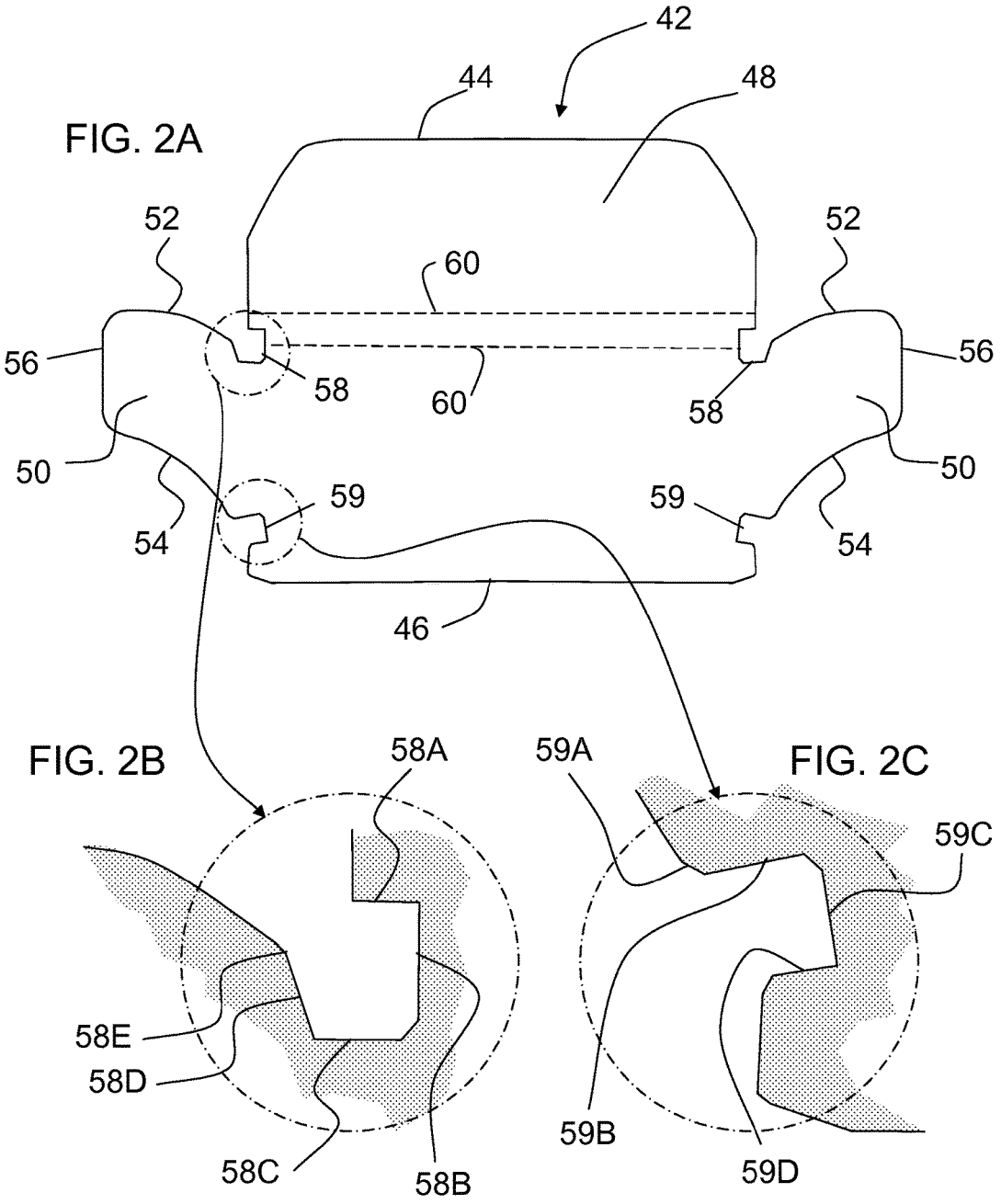
FIG. 2A is a plan view of the tab of FIG. 1A.
FIGS. 2B and 2C are detail views of the tab.

As can be seen in FIG. 1A, the slots 40 are arranged and positioned to receive a tab 42 therein/therethrough to removably couple the tab 42 to the divider 16. More particularly, as shown in FIG. 2A, the tab 42 of FIG. 1A is generally rectangular in front view and includes a top or first edge 44 and a bottom or second edge 46 extending generally parallel to each other. The tab 42 includes a display portion 48 proximate to the first edge 44 of the tab 42, and a pair of laterally extending attachment portions 50, each attachment portion 50 being located on a corner of the tab 42 along the second edge 46, or along the side edges between the first and second edge. The display portion 48 provides a surface which can be written upon or carry a label sticker or the like, and/or may have an inner cavity into which a label can be inserted.

Each laterally extending attachment portion 50 protrudes generally outwardly from the body of the tab 42, and includes curved or angled, generally parallel upper 52 and lower 54 edges extending generally upwardly and outwardly. One or both of upper edge 52 and lower edge 54 may be curved in a concave 'downward' shape, that is, concave in a direction away from display portion 42. Each attachment portion 50 terminates in an outer edge 56 extending generally perpendicular to the top 44 and bottom 46 edges of the tab 42. In the illustrated embodiment, each lower edge 54 of the attachment portion 50 terminates at a position proximate to the lower edge 46 of the tab, and each upper edge 52 terminates at a position proximate to a middle portion of the tab 42. A pair of relief cuts 58 and 59 are positioned where each attachment portion 50 joins the body of the tab 42 to provide increased flexibility thereto and to aid in anchoring the tab into the slots.

A pair of optional score or fold lines 60 may extend across the length of the tab 42, generally parallel to the top 44 and bottom 46 edges. The fold lines 60 can be considered a line of delineation of the display portion 48 of the tab, and provide flexibility such that the display portion 48 can flex in and out of the plane of the tab 42. However, the fold lines 60 may also be used to stiffen the tab so that any flexing in the display portion tends not to extend into the body portion, and thus the body portion may be somewhat isolated from forces that might tend to bow the body and reduce the holding strength of the attachment portions 50. Each fold line 60 can take the form of a score line in which an indentation is formed or cut in the tab 42. The fold lines 60 may both be formed in the top surface of the tab 42, although one, or both, of the fold lines 60 can be formed on the opposite, bottom surface of the tabs 42. Moreover, rather than taking the form of score lines, the fold lines 60 can take the form of creases or pre-folded lines, areas of weakness, or the like. In some embodiments fold lines 60 may be omitted. For example in a die-cutting process it may be easier to manufacture a tab without the fold lines.

In order to couple the tab 42 of FIG. 2A to the divider 16 of FIG. 1A, the tab 42 is positioned adjacent to the upper 26 or outer 32 edges, and one of the attached portions 50 is inserted into one of the slots 40. In FIG. 1A the tab 42 is shown spanning two of the spaces between slots 40. However, the tab may span more or less than two spaces. The height of the attachment portions 50 and/or slots 40 is selected such that the slots 40 may have a height that is only slightly greater than that of the attachment portions 50. Accordingly, in order to insert the curved attachment portion 50 into an associated slot 40, the attachment portion 50 may be pivoted or rotated to guide the attachment portion 50 into/through the slot 40. The relief cutouts 58 and 59 provide increased flexibility to the attachment portions 50 to aid in their insertion. Once one of the attachment portions 50 is inserted into an associated slot 40, the other attachment portion 50 is inserted into another (i.e., adjacent) slot 40 in the same manner.

In this manner, as shown in FIG. 1A, the tab 42 can be releasably secured to the divider 16. The display portion 48 of the tab 42 is configured to at least partially extend beyond the associated top 26/outer edge 32 such that the tab 42 can be seen and gripped by a user. The flex lines 60 enable the display portion 48 of the tab 42 to easily pivot to accommodate forces applied thereto, which avoid the tab 42 breaking off and/or being pulled out of the associated slots 40. In particular as shown in FIG. 2A, the shape of tab 42 strongly resists coming out of the slots 40 when subjected to a pulling force exerted upon display portion 48 or the outward edge 44 of the tab, as may be encountered during typical use of the tab. However the shape allows the tab 42 to be removed from slots 40 without much difficulty by applying a lifting and slight rotational force to the inward edge 46 of the tab.

In order to decouple the tab 42 from the divider 16, each attachment portion 50 is backed out of the associated slot 40, while rotating/pivoting the attachment portions 50. The tab 42 can then be located at a different position on the divider 16, or used in conjunction with a different divider 16, to provide the user flexibility in the use and positioning of tabs 42.

FIGS. 2B and 2C show details of relief cuts 58, and 59 respectively. As shown in FIG. 2B, upper relief cut 58 may include a first portion as an upper edge 58A that may be approximately horizontal, that is, parallel to the longer dimension of the tab as shown in FIG. 2B. A second portion as an inner edge 58B may be approximately vertical. A third portion as a lower edge 58C may be approximately horizontal. A fourth portion as an outer edge 58D may slant outward to an outer corner 58E, from which attachment portion 50 extends along upper edge 52.

As shown in FIG. 2C, as the lower edge 54 extends inward it meets lower relief cut 59 at outer corner 59A. The relief cut may then extend along an upper edge 59B that is approximately horizontal but may slope slightly inward and upward, to an inner edge 59C that may be approximately vertical, and thence to a lower edge 59D that may be approximately horizontal.

The relief cuts may take other shapes, including circles, ovals, and regular or irregular polygons or portions thereof.

Figure 3A:
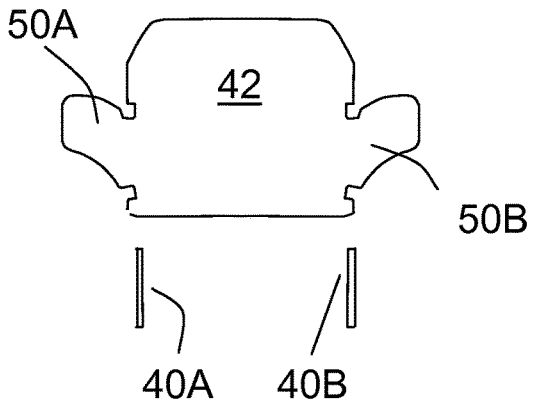
FIGS. 3A-3F show steps in inserting the tab into slots.
Figure 3B:
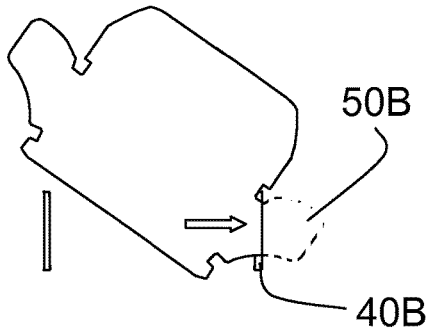
Figure 3C:
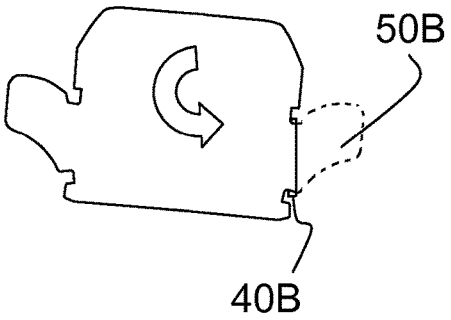
Figure 3D:
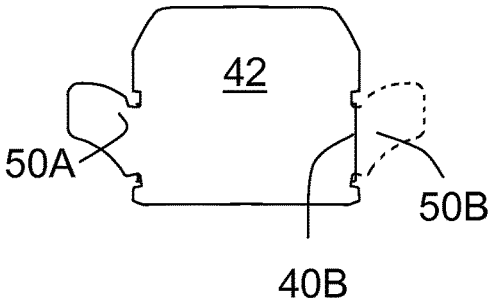

FIG. 3A shows a tab 42 proximate to two slots 40A and 40B that will receive tab attachment portion 50A and 50B respectively. FIGS. 3B to 3F show example steps in the process of inserting the tab into the slots, As shown in FIG. 3B, the tab may be rotated slightly for example about 30 degrees, and attachment portion 50B inserted into slot 40B, so that upper relief cut 58 is received into the upper edge of slot 40. Next, as shown in FIGS. 3C and 3D, the tab may be rotated back to approximately horizontal position so that lower relief cut 59 is received into the lower edge of slot 40B. Certain dimensions are shown in FIG. 4A and enumerated by way of example here. All dimensions given herein, whether relative or actual, are examples. The slot height y1 (16 mm) from its top edge to its bottom edge may be approximately equal to the 'neck' distance h1 (15 mm) from the lower edge 58C of the upper relief cut 58, to the upper edge 59B of the lower relief cut 59. Because of the angle of upper edge 59B, and the shoulder height h4 (18 mm) being nearly equal or slightly greater than slot height y1 (16 mm), the outer corner 59A may encounter some resistance entering (or exiting) the slot. The geometry of the two relief cuts may thus help hold the attachment portion in the slot.

Figure 3E:
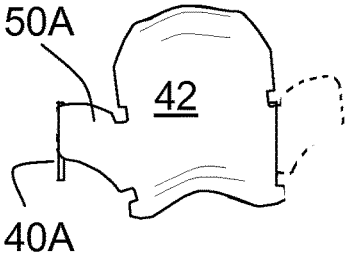
Figure 4A:
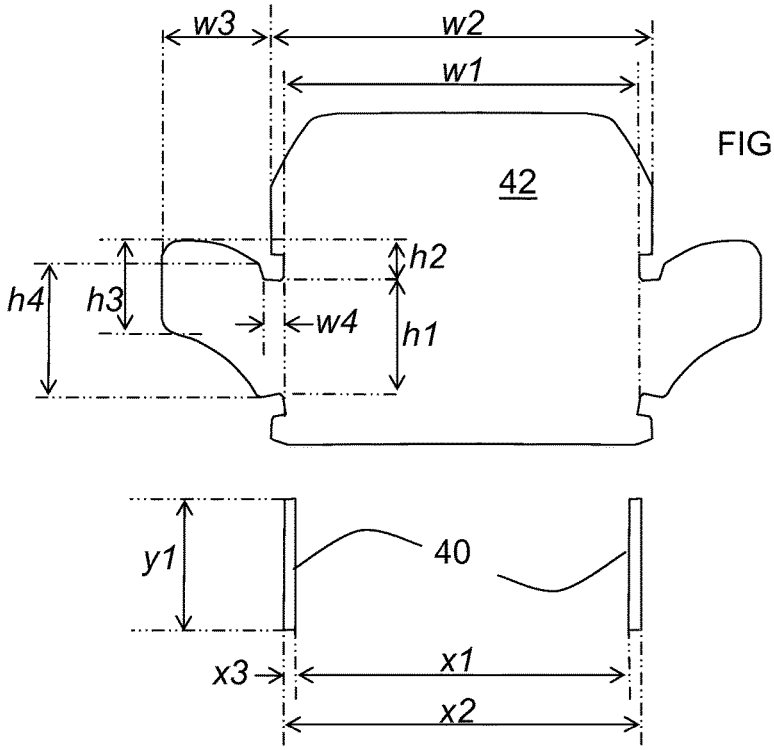
FIGS. 4A and 4B show relative dimensions of the tab and an alternative tab.

With attachment portion 50B securely positioned in slot 40B, tab 42 may be flexed or bowed upward and out of the plane between the slots, as shown in FIG. 3E, to shorten the tab lateral size and allow an edge of attachment portion 50A to enter slot 40A. The tab may be rotated slightly during this step particularly if the upper edge of attachment portion 50A would otherwise be too far upward to enter slot 40A.

Figure 3F:
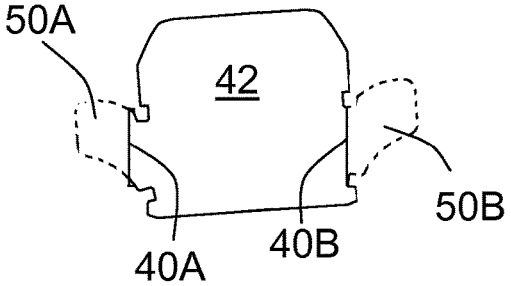

Flexing or bowing of the tab may then be released to allow attachment portion 50A to slide into slot 40A as shown in FIG. 3F. When the attachment portion 50A is almost completely into slot 40A, resistance may be encountered as the height of the attachment portion (such as shoulder height h4) moving through the slot reaches a maximum when outer corners 58E and 59A encounter the slot at about the same time. The resistance then drops as outer corner 58E passes through the slot allowing the attachment portion 50A to easily transition upward due to the sloped area of outer edge 58D. Thus it is seen that the tab 42 with the relief cuts 58, 59 allows the attachment portions both to be easily inserted into the slots, and held securely in place during use. If desired to remove the tab, the process steps may be reversed. The tab lower edge 46 may be flexed upward (as shown in FIG. 3E) and the attachment portion 50A pulled inward and slightly "downward" (e.g. toward the body of the divider) to release it from slot 40A. However, during use the forces on tab 42 are mainly outward from the body of the divider, causing the attachment portions 50 to sit more firmly rather than pull out. Furthermore any tendency of tab display portion 48 to flex upward will be resisted by outer edge 58D of the upper relief cut 58, and the upper parts of attachment portions 50.

The tab 42 and slots 40 are configured such that when a tab 42 is coupled to an associated divider 16, the tab 42 is held securely in place. For example, the particular motion used to decouple a tab 42 from the divider pocket 16 may involve each attachment portion 50 being pulled out while the attachment portions 50 are rotated in opposite directions. Removing the tab may involve a rotation of the tab during at least one of the steps during the removal. Although the removal motion to extract the tab 42 can be accomplished relatively easily and without much force, applying movement to tab 42 such as flexing out of the plane of the divider, or rotating the tab, during normal use of the notebook would be unusual or unexpected. Thus, although the tabs 42 can be easily manually removed when desired, they can generally be expected to remain in place during normal use.

FIG. 4A shows dimensions of tab 42 relative to slots 40. These dimensions whether relative or actual, are only examples. Certain features of the tab are identified in FIGS. 2A-2C. The tab may have a first major width w1 (e.g. 46 mm) between inner edge 58B of the upper relief cut 58. Width w1 may also represent the width between inner edge 59C of the lower relief cut 59. This width w1 may be approximately equal to, or slightly less than, the slot outer spacing x2 (52 mm) between the outer edges of the two slots 40 into which the tab is being inserted. The upper portion of the tab may have a second major width w2 (51 mm) that may be less than, about equal to, or greater than slot outer spacing x2.

Attachment portion 50 may have a extension width w3 (15 mm) large enough combined with dimension w1 or w2 so that the sum (about 65 mm) is sufficiently greater than slot outer spacing x2 (52 mm) such that, once a first one of the attachment portions 50 has been inserted into its associated slot, tab 42 will require some flexing or bowing in order to start the second of the attachment portions 50 into its associated slot. Thus extension width w3 may be, for example, from about 10% to 50% of width w1 or w2 (e.g., 5 to 25 mm), depending on manufacturing preference and such factors as the stiffness of the tab material. Attachment portion 50 may have a distal or outer height h3 (13 mm) that is sufficiently less than slot height y1 (16 mm) so as to enable the attachment portion 50 to be easily started into the slot. Near its proximal or inner end, attachment portion 50 may have a shoulder height h4 (18 mm) that is greater than h3 and is approximately equal to or somewhat greater than slot height y1 (16 mm), so that the shoulder height h4 causes the attachment portion 50 to encounter at least slight resistance when moving though slot 40. Slightly inward relative to the shoulder height h4, at the juncture of the attachment portion 50 with the body of the tab, the height may drop to neck height h1 (15 mm) that may be approximately equal to or slightly less than slot height y1 (16 mm). Neck height h1 may extend horizontally over a width w4 (3 mm) providing a relaxed or resting position in which attachment portion 50 rests in slot 40. Slot 40 may have a slot width x3 (3 mm) that may be just a narrow slit or may be wide enough so as to allow easily starting the distal end of attachment portion 50 into slot 40. The upper and or lower ends of slot 40 may be squared off or rounded.

When installed in slots 40, an upward portion of the attachment portion 50 may extend an upward extension distance h2 (5 mm) above the top of slot 40. For example this may represent the height of the 'highest' edge of attachment portion 50, relative to lower edge 58C of upper relief cut 58. The upward portion may help retain the tab in place. Upward extension height h2 may, for example, range from about 10% to about 50% of slot height y1.

Attachment portion 50 may have a curved shape. As shown in FIG. 4A, the shape may be concave downward, that is, become more horizontal further out from the tab body. However the shape may instead be concave upward, that is become more vertical further out from the tab body. Alternately attachment portion 50 may have straight edges replacing one or more of its curved edges.

Figure 4B:
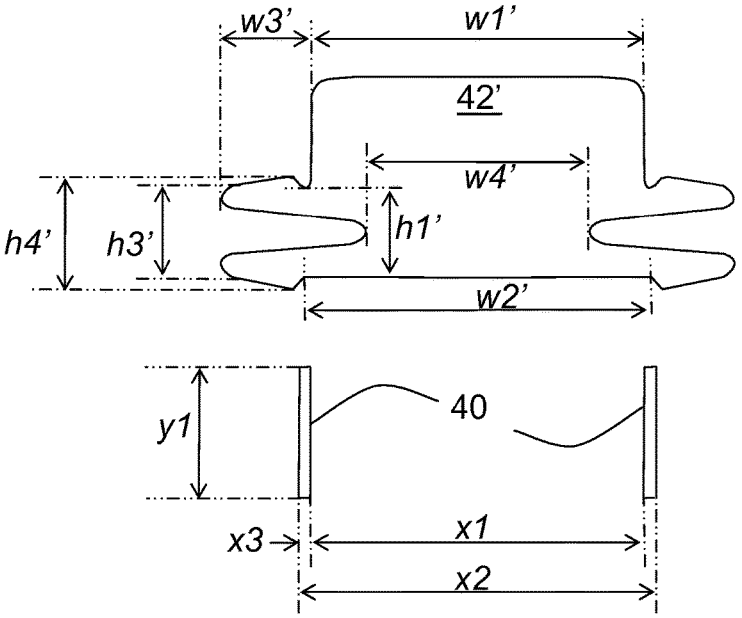

FIG. 4B shows dimensions of alternative tab 42' relative to slots 40. This tab will be further described below and certain features identified in FIG. 5. The dimensions discussed are examples. Tab 42' may have a width w1' (51 mm) across its display portion 48. This width w1 may be approximately equal to, or slightly less than, the slot outer spacing x2 (52 mm) between the outer edges of the two slots 40 into which the tab is being inserted.

Attachment portion 50 may have a width w3' (15 mm) sufficiently greater than slot outer spacing x2 so that, once a first one of the attachment portions 50 has been inserted into its associated slot, tab 42' will require some flexing or bowing in order to start the second of the attachment portions 50 into its associated slot. Width w3' may be, for example, from 10% to 50% of width w1' (e.g., 5 to 25 mm). Attachment portion 50 may have a distal or outer height h3' (13 mm) that is sufficiently less than slot height y1 (16 mm) so as to enable the attachment portion 50 to be easily started into the slot. Near its proximal or inner end, attachment portion 50 may have a shoulder height h4' (18 mm) that is greater than h3' and is somewhat greater than slot height y1, so that the shoulder height h4' causes the attachment portion 50 to encounter at least slight resistance—and even to require legs 66 to flex toward one another when moving though slot 40. Shoulder height h4' may be, for example, from about 10% to about 50% larger than slot height y1

(e.g., from 18 to 30 mm). Slightly inward relative to the shoulder height h4', at the juncture with the body of the tab, the height may drop to a radiused corner or plateau defining a height h1' (15 mm) as shown, which may be approximately equal to or slightly less than slot height y1. Height h1' thus may provide a relaxed or resting position in which attachment portion 50 rests in slot 40. Slot 40 may have a width x3 (3 mm) that may be just a narrow slit or may be wide enough so as to allow easily starting the distal end of attachment portion 50 into slot 40.

Lower edge 46 of tab 42' may have a width w2' (47 mm) between the shoulders of the lower legs 66. Width w2' may be approximately equal to or somewhat greater than the inside distance x1 (45 mm) between the associated pair of slots 40. Thus when inserted into the slots, the ends of the lower legs may expand once passing through the slots. Between each pair of upper and lower legs 66 may be provided a gap 69 which may allow the upper and lower legs to more readily flex toward one another. The gap 69 may be defined by a cutaway area as shown, or by simply a slit. The distance w4' between opposing gaps 69 may be somewhat less than the slot width x1 or x2. However distance w4', as well as the shape of gaps 69, may be chosen to provide the desired amount of flex between the upper and lower legs 66. Besides being less than the slot width x1 or x2, the distance w4' may be approximately equal to or even greater than slot x1 or x2.

Figure 5:
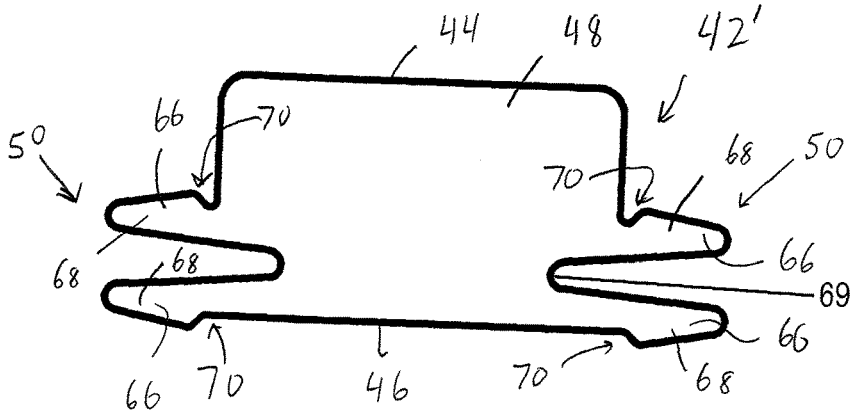
FIG. 5 is a plan view of the alternative tab.
Figure 6:
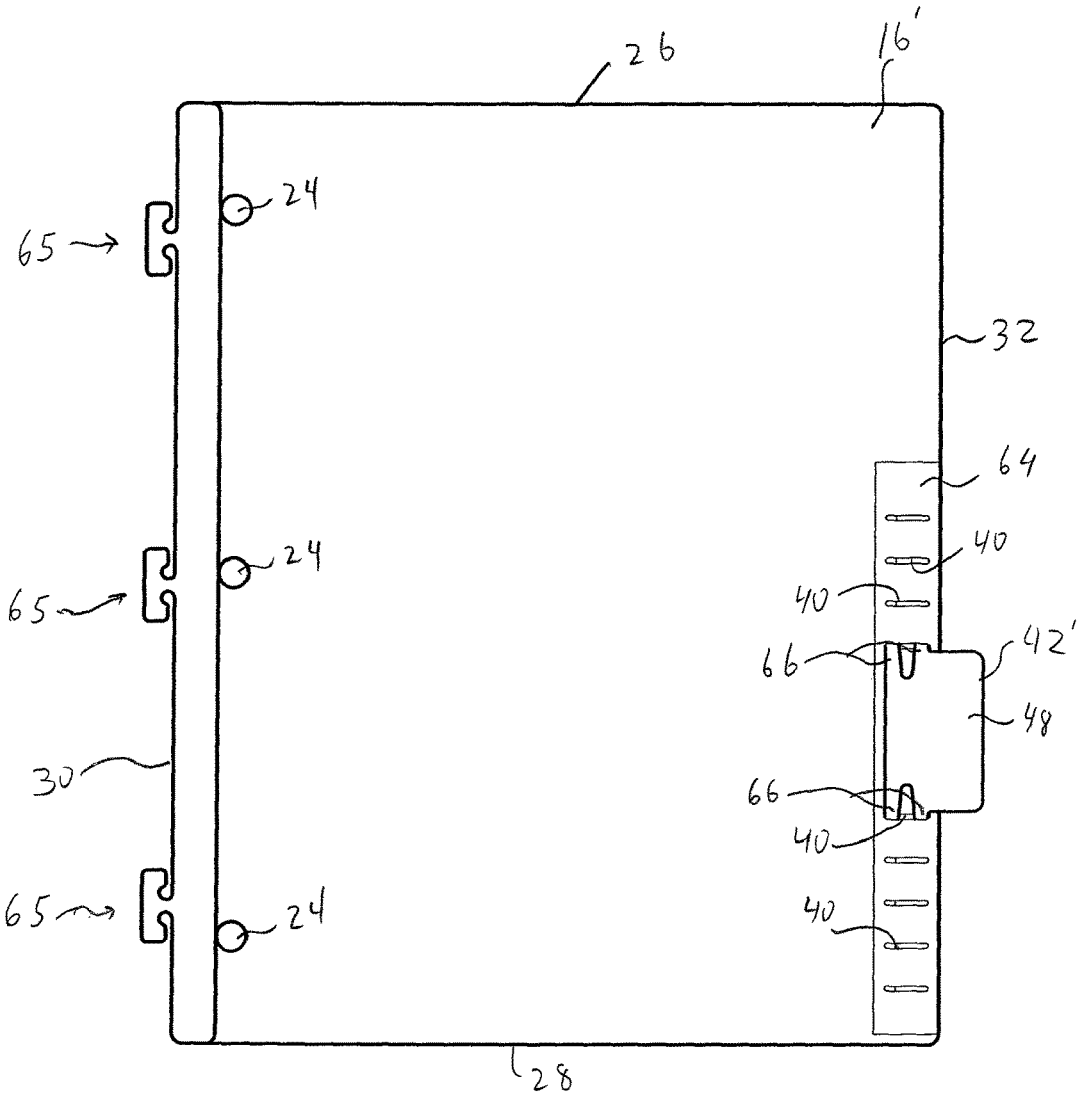
FIG. 6 is a plan view of an alternative divider incorporating the tab of FIG. 5.

FIG. 5 also illustrates the embodiment 42' of the tab shown in FIG. 4B. FIG. 6 shows a divider 16' that may be coupled to the notebook 10 of FIG. 1A by the binding device 20. The divider 16' lacks the outer pocket 38 of the divider 16 of FIG. 1A (although the divider 16' may include internal pockets), and also includes a plurality of "wings" 65 extending inwardly from the inner edge thereof to act as a coupling mechanism to couple the divider 16' to a coil or spiral binding mechanism. Such a coupling mechanism is disclosed, for example, in U.S. Pat. No. 6,672,785 to O'Hara et al., the entire contents of which are incorporated herein by reference. In the illustrated embodiment, the divider 16' includes a flap of material 64 folded over its outer edge 32 which carries the slots 40.

As shown in FIG. 5, and previously discussed relative to FIG. 4B, in this embodiment each attachment portion 50 of the tab 42' includes a pair of generally parallel, spaced-apart outwardly extending legs 66, each leg 66 extending generally parallel to the top 44 and bottom 46 edges of the tab 42'. Each leg 66 has a generally triangular-shaped tip 68 having or contributing an area of lesser thickness at its end, increasing to an area of greater thickness toward the base of each leg 66. Each leg 66 also has a tapered surface 70 positioned at the base of each leg 66 forming a notch.

In order to couple the tab 42' of FIG. 5 to the divider 16' of FIG. 6, a first set of legs 66 of an attachment portion 50 is initially inserted into one of the slots 40. As the tab attachment portion 50 is urged into the associated slot 40, the increased thickness presented by the tips 68 of the legs 66 causes the legs 66 to be urged/squeezed together. Finally, once the legs 66/attachment portion 50 is sufficiently inserted into the slot 40, the notches 70 become aligned with the slots 40, thereby allowing the legs 66 to spring outwardly securing the attachment portion 50 in the slot 40. The opposite attachment portion 50 of the tab 42' is then inserted into the associated (i.e., adjacent) slot 40 in a similar manner.

Thus, in this embodiment, each tab 42' is again securely coupled to the associated divider 16' such that the tab 42' is not easily removed. However, when it is desired to remove the tab 42', each attachment portion 50 can be manually pulled from the slot 40, as the angled/chamfered edges 70 will allow the legs 66 to be urged together when sufficient force is applied, thereby decreasing the effective height of the attachment portion 50 and allowing the attachment portion 50 to be extracted out from the associated slot 40. Although both legs 66 are shown as having an area of increased thickness 68, if desired, only one leg 66 of each attachment portion 50 may have the increased thickness characteristics. The slots 40 of the divider 16' may be of generally the same size, shape and spacing of the slots 40 of the divider 16 of FIG. 1A, such that the tabs 42, 42' can be used interchangeably, although it is also possible for the size, shape and/or spacing of the slots 40 to differ.

Tabs 42, 42' may be made of a sturdy but resilient material such as a paperboard, cardboard, polymer, plastic and the like. The material may be flexible enough to allow bowing and flexing as described for inserting and removing the tab from the divider. However, the material may also be stiff enough or elastic enough to spring back into original shape once bowing or flexing forces are removed.

Figure 7:
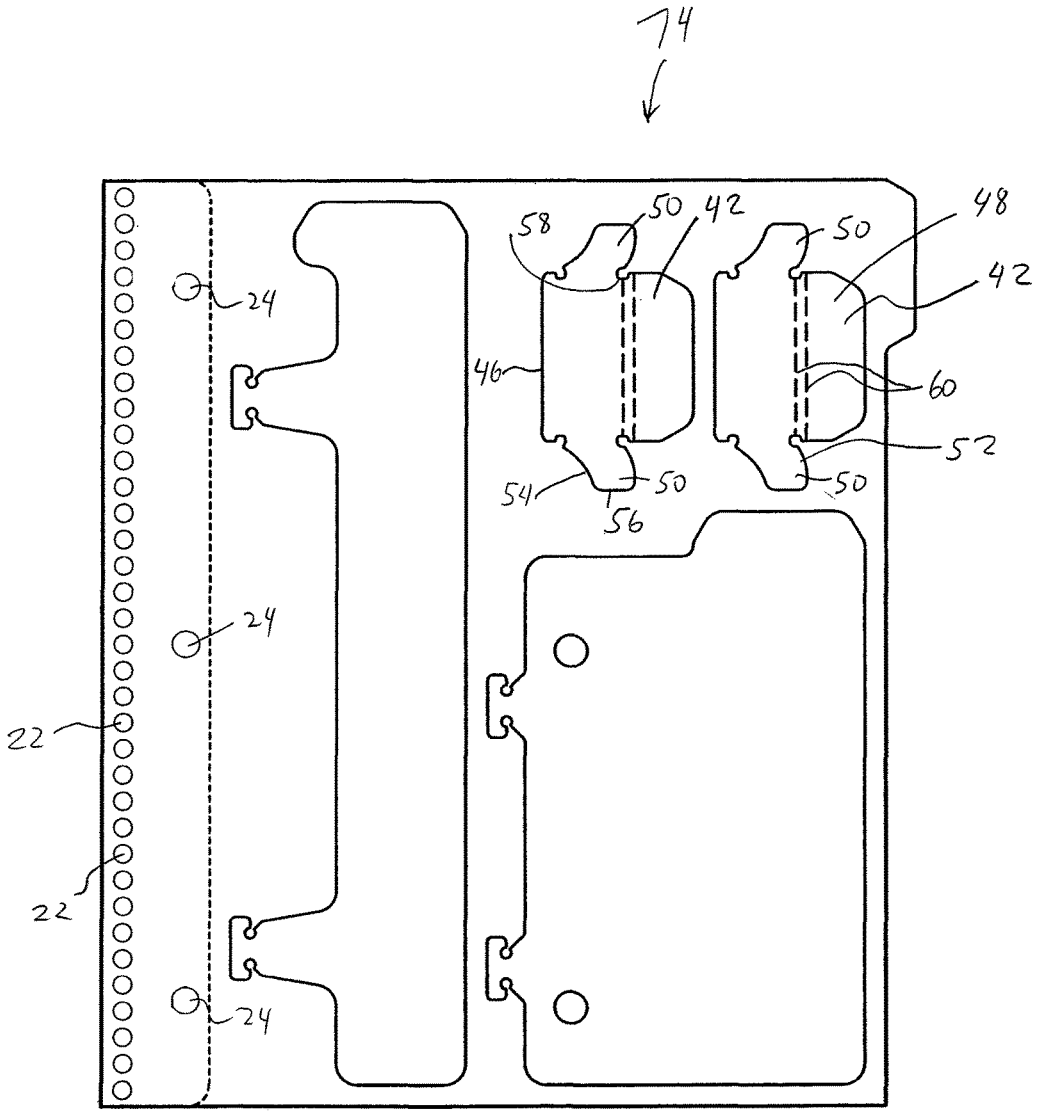
FIG. 7 is a plan view of a tab-supplying insert.

As shown in FIG. 7, an insert sheet 74 may be provided and coupled to the notebook 10 of FIG. 1A by the binding device 20. The insert sheet 74 may include a plurality of holes 22 proximate to its inner edge for receiving at least part of the binding device 20 therethrough. The insert sheet 74 can be made of a polymer, cardboard or other material having a plurality of components partially, but not entirely, die cut therein. The sheet of FIG. 7 illustrates two tabs 42 of FIG. 2A die cut therein, although the tab of FIGS. 5 and 6, and/or other suitable tabs, may be included. In this manner, when the user desires to use a tab 42, the tabs 42 can be separated from the remainder of the sheet 74 and utilized as desired. Thus, the sheet 74 of FIG. 7 provides a convenient method for storing and supplying the tabs 42 to the user such that they are provided and available for use when desired.

Although the invention is shown and described with respect to certain embodiments, it should be clear that modifications will occur to those skilled in the art upon reading and understanding the specification, and the present invention includes all such modifications.

What is claimed is:

1. A tab for attachment to a component having a pair of slots therein or therethrough, each slot having a slot height extending in a first direction, the tab comprising:

a flat display portion proximate to a first edge of the tab; and a pair of attachment portions extending outwardly in a lateral direction perpendicular to the first direction, each attachment portion being located on a side edge of the tab or on a corner of the tab that is positioned along a second edge opposite from the first edge, wherein both attachment portions are located mutually opposite of said display portion with respect to the first direction, and wherein:

(i) each attachment portion includes curved or angled upper and lower co-planar edges, wherein said upper and lower edges of each attachment portion are predominantly parallel to enable each attachment portion to be inserted into a slot, wherein each attachment portion is coupled to said tab at a base of the respective attachment portion, and wherein said tab includes a pair of relief cutouts positioned adjacent to the base of each attachment portion, each pair with one cutout being co-planar with the associated upper edge and with another cutout being co-planar with the associated lower edge, and wherein the relief cutouts are configured to enable said tab to be secured to said component in a flat configuration and resist removal therefrom; or (ii) each attachment portion includes a pair of spaced-apart, outwardly-extending co-planar legs wherein the pair has a collective height that is greater than the slot height, and wherein at least one leg in each attachment portion is configured to be reversibly and springingly movable toward the other leg to enable said legs to fit through an associated one of the pair of slots to couple said tab to the component.

2. The tab of claim 1, wherein the slots have a slot spacing therebetween extending in a second direction, and wherein each attachment portion extends laterally a distance of between 10% and 50% of the slot spacing.

3. The tab of claim 1, wherein at least one of said upper or lower edges is curved along an entire length thereof and is concave in a direction away from the display portion.

4. The tab of claim 1, wherein each attachment portion, at a juncture of that attachment portion with the tab, has a neck portion with a neck height approximately equal to the slot height, and the tab is positionable in an installed position wherein the neck portion is received into the slot.

5. The tab of claim 4, wherein each attachment portion has a shoulder portion adjoining the neck portion outside the juncture of that attachment portion with the tab, and the shoulder portion has a shoulder height greater than the slot height.

6. The tab of claim 4, wherein each attachment portion has an upward extension portion extending upward relative to the neck portion, and when the tab is in the installed position, the upward extension portion extends upward beyond the slot height.

7. The tab of claim 1 wherein each lower edge of each attachment portion terminates at a position adjacent to but spaced away from a lower edge of said tab, and wherein each upper edge of each attachment terminates at a position adjacent a middle portion of said tab.

8. The tab of claim 1 further comprising said component including a pair of spaced, parallel slots, wherein each attachment portion is received in one of said slots to removably couple said tab to said component.

9. The tab of claim 8 wherein each attachment portion includes curved, predominantly parallel upper and lower edges having a maximum spacing therebetween approximately equal to the slot height.

10. The tab of claim 1 wherein each attachment portion includes the pair of spaced-apart, outwardly-extending co-planar legs.

11. The tab of claim 10 wherein each leg extends parallel to said first and second edges of said tab.

12. The tab of claim 10 wherein at least one leg of each attachment portion increases in thickness in a direction away from a base of said leg.

13. The tab of claim 12 wherein at least one leg of each attachment portion includes a notch formed therein spaced away from a distal end thereof.

14. The tab of claim 1 wherein each attachment portion includes the pair of spaced-apart, outwardly-extending co-planar legs, each leg in each attachment portion having a gap therebetween which is co-planar with the associated legs, wherein said gap is configured to reduce in size when said legs in an associated attachment portion are moved closer to each other in a plane of said tab to enable said legs to fit through an associated slot.

15. The tab of claim 1 wherein each attachment portion is flat and planar, and wherein each upper edge is positioned along an outer edge of the associated attachment portion and each lower edge is positioned along another, opposite outer edge of the associated attachment portion.

16. The tab of claim 1 wherein the upper and lower edges of each attachment portion are spaced apart in a direction in a plane of said tab.

17. A tab system comprising:

a sheet of material having a bound edge and a free edge, said sheet of material including at least one pair of slots positioned adjacent to said free edge, said at least one pair of slots having a spacing therebetween; and a tab releasably coupleable to said sheet of material, said tab including a flat display portion proximate to a first edge of the tab, said tab further including a pair of attachment portions, each attachment portion being located on a side edge of the tab, or at a corner of the tab, wherein each attachment portion is receivable through one of said slots, wherein both attachment portions are located mutually opposite of said display portion with respect to a direction parallel to said slots, and further wherein:

(i) each attachment portion includes curved or angled, uppermost and lowermost co-planar edges, wherein said uppermost and lowermost edges of each attachment portion are predominantly parallel to enable each attachment portion to be inserted into a slot, wherein said tab includes a pair of cutouts positioned adjacent to a base of each attachment portion, with one cutout of each pair of cutouts being positioned in adjoinment with the uppermost edge of the associated attachment portion and the other cutout of each pair of cutouts being positioned in adjoinment with the lowermost edge of the associated attachment portion, and wherein each attachment portion protrudes outwardly from said tab in a lateral direction and wherein said pairs of cutouts are spaced away from each other along said lateral direction, and wherein one cutout of each pair of cutouts is spaced away from the other cutout of that pair of cutouts in a direction perpendicular to said lateral direction; or (ii) each attachment portion includes a pair of spaced-apart, outwardly-extending co-planar legs wherein the pair has a collective height that is greater than the slot height, and wherein at least one leg in each attachment portion is configured to be reversibly and springingly movable away from the flat display portion and toward the other leg to enable said legs to fit through an associated one of the at least one pair of slots to couple said tab to the sheet of material.

18. The tab system of claim 17 wherein said slots are parallel to each other and extend perpendicular to the free edge.

19. The tab system of claim 17 wherein each cutout in each pair of cutouts are coplanar, and wherein said pair of cutouts are coplanar.

20. A tab system including a tab for attachment to a component comprising:

a display portion; and a pair of attachment portions positioned at opposite ends of said tab with respect to a first direction and protruding outwardly therefrom, each attachment portion including a pair of spaced-apart upper and lower co-planar curved or angled edges, wherein said tab includes a pair of co-planar cutouts positioned adjacent to a base of each attachment portion, one cutout of each pair of cutouts being positioned in adjoinment with the upper edge of the associated attachment portion and the other cutout of each pair of cutouts being positioned in adjoinment with the lower edge of the associated attachment portion, each pair of cutouts being aligned with respect to a second direction perpendicular to said first direction, and wherein said attachment portions and pairs of co-planar cutouts are mutually opposite of said display portion with respect to said second direction.

21. The tab system of claim 20 further comprising said component, the component including a pair of spaced-apart, parallel slots, each slot having a slot height, and a slot spacing between said slots, wherein each attachment portion is configured to fit through one of said slots to couple said tab to said component.

22. The tab system of claim 20 wherein said display portion has a predominantly straight outer distal edge, and wherein each curved or angled edge is curved or angled relative to said outer edge.

23. The tab system of claim 20 further comprising said component, the component including a pair of spaced-apart, parallel slots, each slot having a slot height, and a slot spacing between said slots, and wherein a distance between said attachment portions in the first direction is less than said slot spacing to enable said tab to be secured to said component in a flat configuration.

24. The tab system of claim 20 wherein said pairs of cutouts are coplanar with respect to each other.

25. The tab system of claim 20 wherein said upper and lower edges of each attachment portion are predominantly parallel to enable each attachment portion to be inserted into a slot.

26. The tab system of claim 20 wherein each attachment portion is single ply and wherein each attachment portion is a continuous component, and wherein each attachment portion is coupled to said display portion at said base thereof.

27. The tab system of claim 20 wherein each attachment portion protrudes outwardly from said tab in a lateral direction and wherein said pairs of cutouts are spaced away from each other along said lateral direction, and wherein one cutout of each pair of cutouts is spaced away from the other cutout of such pair of cutouts in a direction perpendicular to said lateral direction.

28. The tab system of claim 27 wherein an entirety of both pairs of cutouts are positioned mutually opposite of said display portion along said direction perpendicular to said lateral direction.

29. The tab system of claim 20 wherein both of said attachment portions are located on a same side of said display portion.

30. The tab system of claim 20 wherein both pairs of cutouts are mutually opposite of said display portion with respect to said second direction.

31. The tab system of claim 20 wherein each attachment portion is positioned between the respective pair of co-planar cutouts with respect to said second direction.

32. The tab system of claim 20 wherein no part of said display portion is positioned between any of said cutouts with respect to said first direction.

33. The tab system of claim 20 wherein no part of said display portion is positioned between any of said cutouts with respect to said second direction.

34. The tab system of claim 20 wherein the upper and lower edges of one of said attachment portions are curved, and wherein the upper and lower edges of the other one of said attachment portions are curved.

35. The tab system of claim 20 wherein the display portion is a flat, planar component.

36. The tab system of claim 20 wherein at least part of said display portion protrudes outwardly beyond said both of said attachment portions in said second direction.

37. The tab system of claim 20 wherein both attachment portions are entirely positioned on a same side of said display portion with respect to said second direction.

* * * * *